US006422438B1

(12) United States Patent
Batts

(10) Patent No.: US 6,422,438 B1
(45) **Date of Patent: *Jul. 23, 2002**

(54) GARMENT HANGER HAVING ONE PIECE MOLDED PINCH CLIP WITH CLIP PROTECTION

(75) Inventor: John H. Batts, Grand Rapids, MI (US)

(73) Assignee: Batts, Inc., Zeeland, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/259,224

(22) Filed: Mar. 1, 1999

(51) Int. Cl.[7] ..... A47G 25/48
(52) U.S. Cl. ..... 223/96; 223/93
(58) Field of Search ..... 223/85, 95, 96, 223/93, 91, 90

(56) References Cited

U.S. PATENT DOCUMENTS

| | | | | | |
|---|---|---|---|---|---|
| 2,407,841 | A | * | 9/1946 | LeRoy | 223/96 |
| 2,648,907 | A | * | 8/1953 | Nicholson | 223/96 |
| 2,889,092 | A | * | 6/1959 | Gibron | 223/96 |
| 3,487,984 | A | * | 1/1970 | Loscalzo et al. | 223/96 |
| 3,767,092 | A | * | 10/1973 | Garrsion | 223/96 |
| 4,023,721 | A | * | 5/1977 | Erthien | 223/96 |
| 4,355,743 | A | * | 10/1982 | Erthien | 223/96 |
| 4,658,996 | A | * | 4/1987 | Warmath | 223/96 |
| 4,660,750 | A | * | 4/1987 | Blanchard | 223/91 |
| 5,212,854 | A | * | 5/1993 | Hollis | 24/487 |
| 5,400,932 | A | * | 3/1995 | Hollis | 223/96 |
| 5,975,384 | A | * | 11/1999 | Manabat | 223/96 |
| 6,019,261 | A | * | 2/2000 | Morgan et al. | 223/96 |
| 6,047,868 | A | | 4/2000 | Petrou et al. | |
| 6,050,461 | A | * | 4/2000 | Batts et al. | 223/96 |
| 6,105,836 | A | * | 8/2000 | Batts et al. | 223/96 |
| 6,119,906 | A | * | 9/2000 | Bond et al. | 223/96 |

* cited by examiner

*Primary Examiner*—Bibhu Mohanty
(74) *Attorney, Agent, or Firm*—Amster, Rothstein & Ebenstein

(57) ABSTRACT

A ship-on garment hanger having shielding means at each end of the hanger body to prevent dislodgement of a garment from the hanger by downwardly and inwardly directed dislodging forces, the hanger and the front and rear jaws of the clamp assemblies at the ends of the hanger body being formed integrally in one piece so that the hanger is ideally suited for production by the chain molding technique and consists of only three separate parts including two spring clips.

10 Claims, 2 Drawing Sheets

GARMENT HANGER HAVING ONE PIECE MOLDED PINCH CLIP WITH CLIP PROTECTION

This invention pertains generally to garment hangers and more specifically to a garment hanger adapted to be employed as a shipping hanger for garment-on-hanger use, said garment hanger having (1) a hanger body assembly in which the hanger body and the front and rear halves of the clamp assembly located at each end portion of the hanger body comprise a single manufactured part so that, when a biasing means is added to each clamp assembly, the body assembly consists of only three parts, and (2) means for precluding dislodgement of a garment from its hanger by dislodgement forces encountered during transportation and push/pull forces arising during manipulation of garments on said hangers by customers in retail outlets. The hanger body assembly is particularly well suited for chain molding whereby the cost of the hanger is at a near absolute minimum.

BACKGROUND OF THE INVENTION

A worldwide mode of doing business in the garment industry has evolved in recent years due to economic factors. For example, garments may be very inexpensively manufactured in less developed countries such as Sri Lanka, the garment hanger factory may be located in Taiwan or Hong Kong, and the garments may be destined for sale in the U.S. Thus it is quite common today for garments to be made in one country, the hangers on which the garments are to be displayed made in another country, and the garment displayed for sale in yet a third country.

At the retail sales level, there is an increasing trend to employ fewer and fewer selling personnel, indeed, the trend has almost reached a self-service mode of selling, though a few sales personnel will always be required for providing style information and fitting. The result however is that the ratio of number of garments to each sales person is increasing. While this ratio does not, in itself, present problems at the retail sale level (due to some extent at least, to lowered expectations of sales clerk assistance by retail customers), the greater number of garments in a retail store department presents logistics problems. For example, at the end of a selling day it is the duty of the sales personnel to straighten up the racks so that a neat and tidy appearance is presented to the eyes of the customers as they enter the department on the next selling day. The greater the number of garments on the racks per each sales person, the greater will be the time required by each sales person to straighten the racks, a fact which is not appreciated by sales personnel at the end of their shift. Part of the straightening process involves pulling a garment, say a size 36 men's slacks, which has been inadvertently placed in the size 38 section of the rack and inserting it into the size 36 section. At the present time this task can be very time consuming and frustrating, especially when the rack space is limited as it always is for a period of time after a new season's inventory has been received. Specifically, the pulling out and pushing in motions of extracting a garment from one location on a rack and inserting the garment into another location on the rack can result in a garment on either the moved hanger or a racked hanger dropping its garment, or at least one side of the garment. This usually occurs when the clip of one hanger engages the clip of another hanger in a direction and with a force to cause one jaw of one of the interfering clips to open slightly, thereby releasing the griping pressure on the garment and letting it drop under the impetus of its own weight.

When such an event occurs the time to straighten a rack is increased, much to the annoyance of the sales personnel.

The problem of contact between two hangers with resultant spillage also occurs in the absence of a need to change the physical location of a garment along the axis of a suspending rack. Specifically, during the course of a selling day adjacent garments will be pulled off the racks, or tilted upwardly for viewing, by customers, following which little or no effort is made to make sure that the viewed garment is returned to a level position. Indeed, at the end of a selling day, some hangers will be level, some will be tipped upwardly at their outer end (i.e. the end closest to the customer), and some will be tipped upwardly at their inner end. The result is a very untidy appearance. To return the garments to a neat, organized condition sales clerks prefer to either simply press downwardly on the upturned hangers or, at most, wiggle adjacent off-tilted hangers back and forth slightly so as to enable the garments to come back to a neutral position in which they hang straight down. Unfortunately these simple hand motions can also result in dropped garments due, to a considerable extent, to unlocking forces being exerted on one jaw of the two jaws which form the clamp assembly at the end of each hanger. A basic cause of this problem is the fact that in most hangers in use today the upper portion of the clamp which extends upwardly above the jaw is exposed in the sense that it projects into space outside the boundaries, and particularly the width-dimensions, of the hanger.

A further problem which is keenly felt by the clothing manufacturers, though only indirectly by the ultimate consumer, is the substantial cost of the hangers currently in wide use in the industry. The current hangers have a seven piece hanger body assembly consisting of the hanger body, a front half and a rear half of each clamp assembly, and two biasing means, such as spring clips, one for each clamp assembly. This substantial number of individual parts increases cost since the fixturing required to assemble the parts is quite extensive and hence substantial labor and capital costs are required. In some hangers one half of each clamp assembly may be molded integrally with the hanger body, but this type of hanger still consists of five individually manufactured components and the associated labor and capital costs are little, if any, reduced as compared to the seven part hanger body assembly.

SUMMARY OF THE INVENTION

This invention is a garment hanger which overcomes all of the above described problems in a single hanger. Specifically, the garment hanger of this invention has a hanger body assembly consisting of a maximum of three individual parts, including two biasing means such as spring clips, and is adapted for chain molding whereby molding costs, and subsequent assembly costs are very substantially reduced over all hangers currently on the market. Further, the hanger (a) during transportation following assembly to a garment, (b) in the retail sales outlet, and (c) at all other times, grip a garment in such a fashion that the gripping pressure is not released and a garment dropped no matter how many shakes and bumps the hanger is subjected to during transportation or how quickly and carelessly garments are pulled from a rack and reinserted by customers, or pressed downwardly from above by the hands of a sales clerk passing over a series of hangers to bring the series into level alignment.

It is a further aim of this invention to accomplish all of the foregoing in a hanger which has a very low profile; that is, a hanger in which the clamp assembly at each end of the generally horizontally oriented hanger body does not project above the upper surface of the hanger body.

BRIEF DESCRIPTION OF THE DRAWING

The invention is illustrated more or less diagrammatically in the accompanying drawing wherein.

DESCRIPTION OF THE INVENTION

Figure 2:
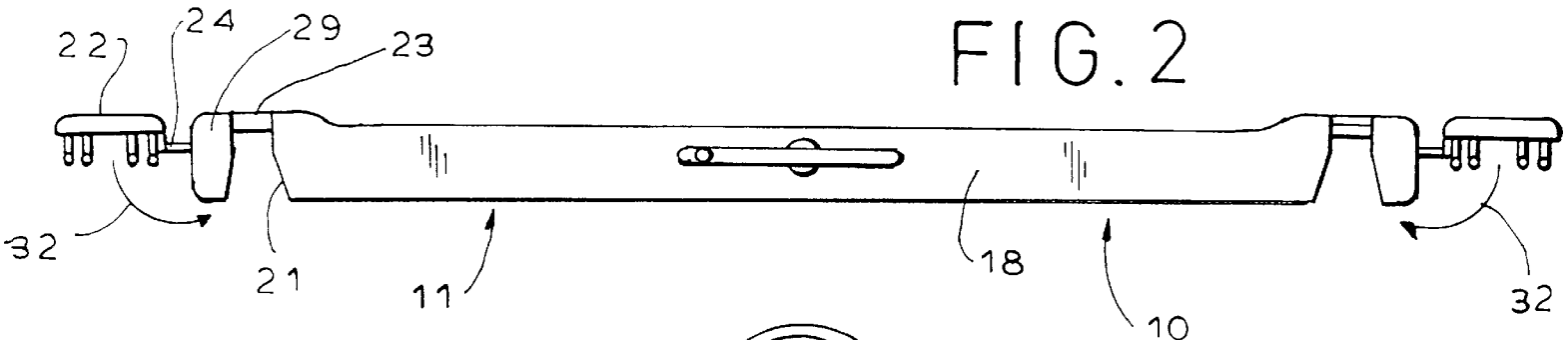
FIG. 2 is a top view.

Like reference numerals will be used to refer to like or similar parts from Figure to Figure in the following description of the invention.

The garment hanger of this invention is particularly well suited for manufacture by the chain molding method and thereafter for assembly to a garment at a remote garment manufacturing location followed by retention of the garment on the hanger until the hanger is separated from the garment at the retail sales outlet by a retail sales clerk or by the purchaser at his home. In view of this highly desirable characteristic the hanger will sometimes hereinafter be referred to as a "ship-on" hanger.

Figure 1:
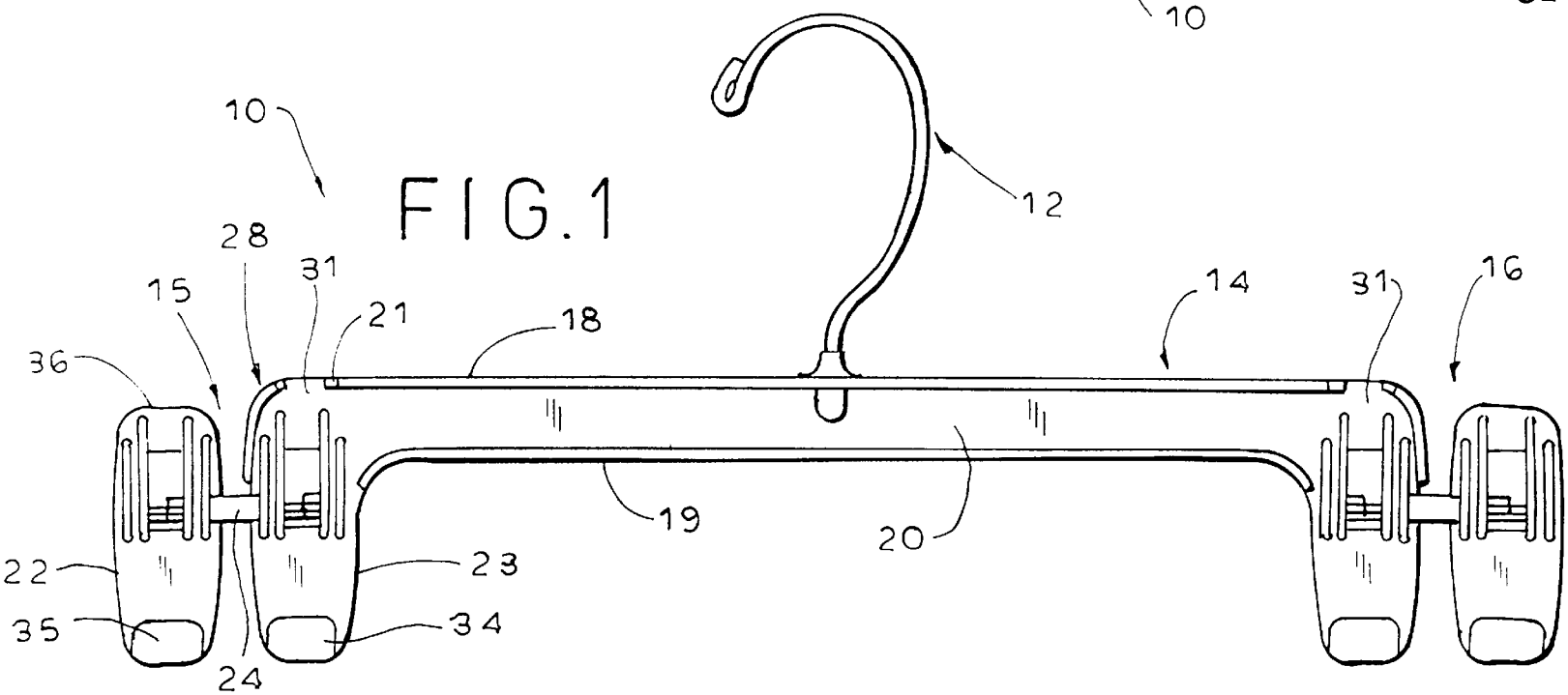
FIG. 1 is a front elevation of the garment hanger of this invention showing the hanger body assembly, without the biasing means, in the just molded condition, a hang means being illustrated for clarity of understanding.
Figures 3, 4, 5:
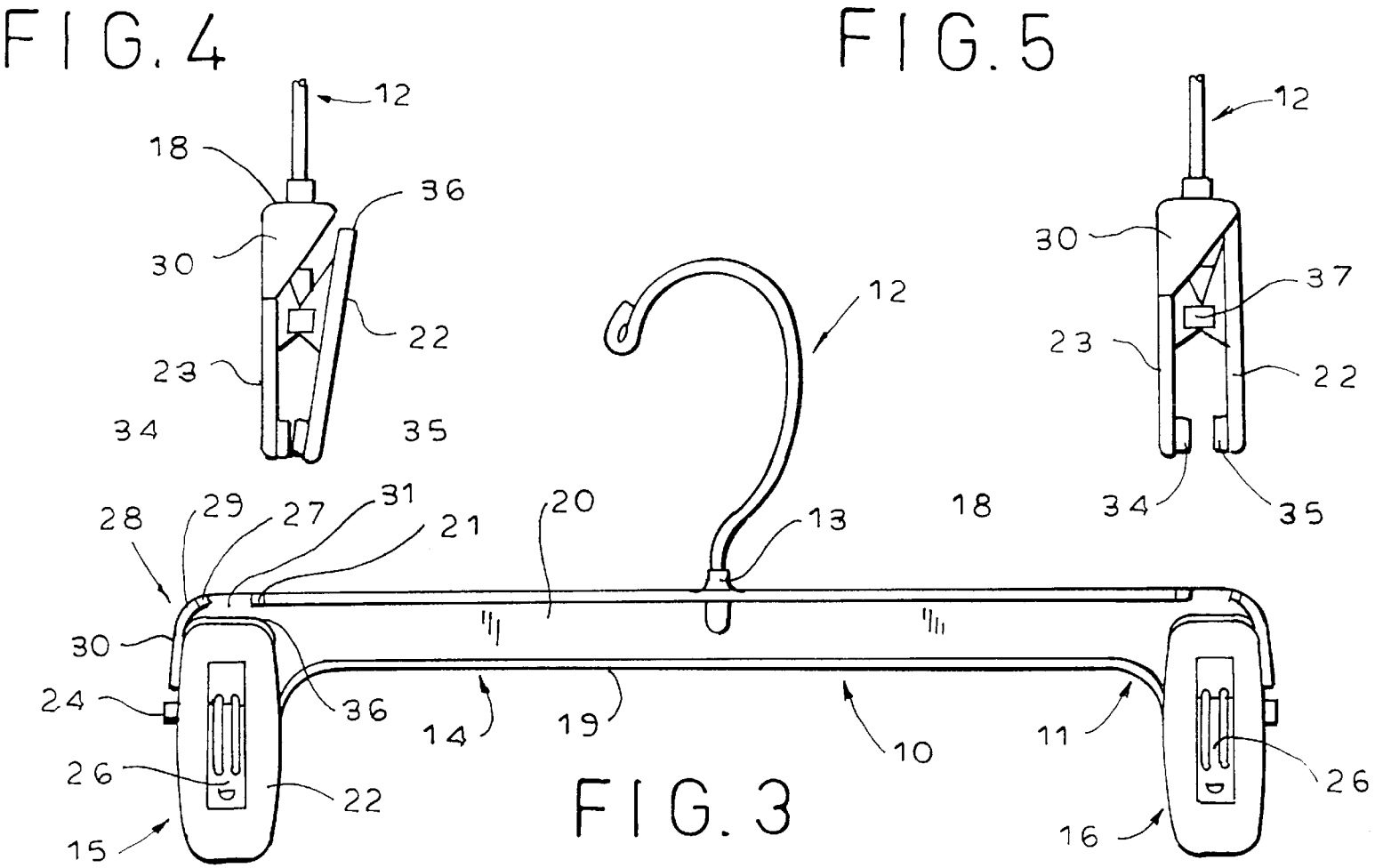
FIG. 3 is a front elevation of the garment hanger in an assembled condition, that is, including the clamp biasing means.
FIG. 4 is a left end view showing the position of the halves of the clamp assembly when not holding a garment.
FIG. 5 is an end view with the garment omitted but showing the position of the jaws when holding a garment when viewed from the left side of FIG. 3.

The ship-on hanger of this invention is indicated generally at 10 in FIGS. 1, 2 and 3. The hanger includes a hanger body assembly, indicated generally at 11, and, in this instance, a hang or hook means indicated generally at 12. In this instance the hanger body assembly 11 and hook means 12 are shown as separate components. It will be understood however that this is a matter of choice since the hook means may be formed integrally with the body, or be formed to the body as a mold insert, or be inserted into its hook boss 13 after the plastic molding operation. It will be understood that any of the current widely used plastic materials are suitable.

The hanger body assembly 11 includes a generally horizontally oriented hanger body, indicated at 14, and a left end clamp assembly and a right end clamp assembly, the clamp assemblies being indicated generally at 15 and 16 respectively. Since the clamp assemblies 15 and 16 are identical, though reversed n position, a description of one will suffice as a description of both.

The hanger body 14 is, in this instance generally C-shaped and consists of an upper flange 18, a lower flange 19, and a vertical central or bight portion 20. From FIGS. 1, 2 and 3 it will be noted that the left end 21 of the upper flange 18 terminates short of the outer portion of the clip assembly 15.

The clip assembly 15 consists of a front half or jaw 22 and a rear half or jaw 23, the two jaws being integrally connected by a strap 24. In FIG. 1 the front and rear jaws and the strap 24 are shown in their as molded position from which it will be obvious that the hanger body and the two clamp assemblies may be integrally molded. In FIG. 3 the front jaw 22 of the clip assembly 15 has been folded about the thin strap 24 to overlie the rear jaw 23 in opposed, matching relationship. The two jaws 22, 23 are held together by a biasing means which in this instance is an inverted U-shaped spring clip 26 seen best in FIG. 3.

Rear jaw 23 is, in this instance, an extension of the vertical central portion 20 of the hanger body, as best seen in FIGS. 1, 2 and 4. A U-curved flange, indicated generally at 28, extends outwardly from the upper left corner of jaw 23, the flange having an upwardly facing portion 29 and a vertical portion 30. The inner edge 27 of the upwardly facing portion 29 and the left end 21 of flange 18 are spaced apart to form an upwardly open space 31 of a width sufficient to receive the spring clip 26 after the front jaw 22 has been swung around 180° along the path of arrow 32 just before the assembly of the spring clip 26 to the left clamp assembly 15.

Garment gripping means 34, 35 are carried on the lower, inwardly facing surface of rear jaw 23 and front jaw 22, respectively, of the clamp assembly 15.

FIG. 5 illustrates the positions of the jaws 22 and 23 when the clamp assembly is in engagement with a garment as represented by center line 33. In this condition the upwardly facing portion 29 of the curved flange 28 together with the left end portion of the upper flange 18 of the hanger body 14 prevent any impact on the upper edge 36 of front jaw 22 which would tend to pivot the front jaw 22 counter-clockwise around the pivot structure 37 and thereby move front gripping means, here a pad 35, away from rear gripping means 34 into an open, garment releasing position.

Similarly, the vertical portion 30 of curved flange 28 together with strap 24 shield the outside of clamp assembly 15, and specifically the front jaw 22, from impact forces which would tend to pivot front jaw 22 counter-clockwise about pivot structure 37 and thereby dislodge a garment gripped between jaws 22 and 23.

It will be understood that the biasing force of the spring clip means will be strong enough to pivot the garment empty jaws about pivot structure 37 and into the position of FIG. 4 in which the garment gripping pads 34 and 35 are in abutting contact. In such position, the upper end 36 of front jaw 22 may project outwardly to some extent from under the protective shield provided by the upwardly facing portion 29 of curved flange 28 and the left end portion of upper flange 18. This is not a disadvantage however when no garment is present.

From FIGS. 1 and 2 it will be appreciated that, since the central portion 20 and flanges 18 and 19 of the hanger body 14, and the jaws 22, 23 and strap 24, are integral and aligned, the hanger body assembly is ideally suited for chain molding which, as is well known, is one of the least expensive molding methods.

To assemble, each connecting strap 24 is bent 180°, as represented by arrows 32, until the clamp halves 22 and 23 of each clamp assembly are in opposing, overlapping or matched relationship as seen in FIG. 3. At this point a conventional U-shaped spring clip 26 is inserted downwardly in the inverted position through a space 31 and into gripping engagement with the outside faces of each of the clamp halves. The spring clip 26 biases the clamp halves 22 and 23, in the absence of a garment, into the position of FIG. 4 in which the front and rear gripping means, or pads, are in abutting contact with one another.

Although a specific example, and modifications thereof, have been illustrated and described, it will at once be apparent to those skilled in the art that modifications to the basic inventive concept may be made within the spirit and scope of the invention. Hence the scope of the invention should only be limited only by the scope of the hereafter appended claims when interpreted in light of the relevant prior art, and not by the foregoing exemplary description.

I claim:

1. A garment hanger comprising:

a generally horizontally disposed hanger body;

an actuable clamp assembly at each end of the hanger body, wherein said clamp assemblies are molded integral with said hanger body;

said clamp assembly including a front jaw adjacent to a rear jaw and a strap, said strap connecting said front jaw to said rear jaw such that said front jay may be laterally folded about said strap to overlie said rear jaw;

said front jaw and said rear jaw having lower opposing ends and upper opposing ends, wherein said front and rear jaws are connected to a central pivot axis about which each of said jaws is pivotable; and a spring inserted on said overlying front and rear jaws so that said lower opposing ends are biased into a garment holding position and said upper opposing ends are biased away from each other.

2. The combination of claim 1 further characterized in that said lower opposing ends of said jaws being movable away from one another to form an opening in which a garment to be suspended may be inserted prior to clamping.

3. The combination of claim 2 further characterized in that said straps are sufficiently flexible to enable the jaws to be oriented in an opposed matching position preparatory to being bendably joined by the spring means.

4. The combination of claim 1, further comprising shields formed on said hanger body wherein said shields cover the upper opposing ends of said clamp assemblies when in a garment gripping position.

5. The combination of claim 4 wherein said shield is a flange-like projection which extends outwardly from said rear jaw to a position in which it covers at least the upper portion of the end edges of said clamp assemblies.

6. The combination of claim 4, wherein said shields protect the clamp assembly from impacts imposed vertically downward on each clamp assembly and horizontally inwardly from the ends of the hanger body.

7. The combination of claim 1, where said front jaw is folded approximately one hundred eighty degrees about said strap to overlie said rear jaw.

8. The combination of claim 1, wherein said garment hanger body, said front jaws and said rear jaws are integral and aligned.

9. The combination of claim 8, where said garment hanger is manufactured by chain molding.

10. The combination of claim 1, wherein said hanger body further comprises:

a vertical central portion and an upper flange;

a U-curved flange extending outwardly from said vertical central portion at an upper corner of said front jaws; and a space between said upper flange and said U-curve flange, wherein said U-curved flange protects said clamp assemblies from external vertical and horizontal forces.

* * * * *